United States Patent [19]

Lipscomb et al.

[11] Patent Number: 4,666,154

[45] Date of Patent: May 19, 1987

[54] EXERCISE DEVICE

[75] Inventors: John F. Lipscomb, Springfield; Gary L. Fox, Joplin, both of Mo.

[73] Assignee: JFL Laboratories, Inc., Ozark, Mo.

[21] Appl. No.: 698,431

[22] Filed: Feb. 5, 1985

[51] Int. Cl.[4] ..... A63B 3/00; A63B 23/00

[52] U.S. Cl. ..... 272/144; 272/63

[58] Field of Search ..... 272/144, 112, 113, 63, 272/62, 109, 70.3; 248/371, 372.1, 394, 398; D21/191

[56] References Cited

U.S. PATENT DOCUMENTS

| | | | |
|---|---|---|---|
| 3,121,551 | 2/1964 | Ancell et al. | 248/371 |
| 3,211,452 | 10/1965 | Ahrens | 272/144 X |
| 3,735,979 | 5/1973 | Levenberg | 272/144 |
| 3,891,207 | 6/1975 | Helliwell | 272/62 X |
| 3,948,513 | 4/1976 | Pfotenhauer | 272/134 |
| 4,337,942 | 7/1982 | Sidlinger et al. | 272/144 |

FOREIGN PATENT DOCUMENTS

| | | | |
|---|---|---|---|
| 904366 | 7/1972 | Canada | 272/144 |
| 2445726 | 9/1980 | France | 272/144 |
| 405965 | 10/1943 | Italy | 272/144 |

*Primary Examiner*—Richard J. Apley
*Assistant Examiner*—S. R. Crow
*Attorney, Agent, or Firm*—Haverstock, Garrett and Roberts

[57] ABSTRACT

An exercise device has two side bars each comprising a longitudinal segment extending between front and rear legs. The angle and length of the front and rear legs produces an incline of the longitudinal segment. The angle of incline is variable because the front and rear legs are separately adjustable in length. Slip locks selectively lock each leg at a desired length. Cross bars connected between the side bars by quick release locks. A central longitudinal bar parallel to the side bars extends between a selected two of the cross bars and is connected thereto by quick release locks.

13 Claims, 25 Drawing Figures

EXERCISE DEVICE

BACKGROUND OF THE INVENTION

This invention relates to an exercise device and more particularly to a combination of bars that can be selectively assembled to produce a free-standing adjustable apparatus on which a variety of exercises can be performed. This exercise device incorporates a principal of utilizing body weight as the sole resistance to an exercise, and the design of the device allows variations in the resistance created by the body weight for each particular exercise.

Exercise devices and apparatuses have, of course, been available for years in great variety. These devices and apparatuses range from dumbells and weight sets to parallel bars to chin-up bars to counterbalanced machines and to various motor driven apparatuses as well as springs, straps and chains. The dumbells have limited application to limited sets of muscles. The weight sets are very heavy and cumbersome since they rely on mechanical weight as the source of resistance. The parallel bars have limited use as does a device such as a chin-up bar. The counterbalanced means are typically directed toward conditioning of limited muscles of the body, are very expensive, are heavy and occupy considerable floor space. Motor driven apparatuses are even more expensive and typically require considerable floor space to condition only selected muscles of the body. This exercise device is an improvement over all prior art devices and apparatuses in that it incorporates in a single free standing exercise device a means for exercising all muscles of the body, both individually and in selected combinations with no moving parts.

SUMMARY OF THE INVENTION

This exercise device comprises a pair of side rails and a plurality of cross bars. Each side rail has front and rear legs of different lengths and a longitudinal bar extending between the front and rear legs. Preferably, the longitudinal bar with its front and rear legs is formed of a single piece of pipe bent to the desired shape. Each longitudinal bar intersects its associated front leg at about a 90° angle in a smooth bend and intersects the rear leg at about a 120° angle in a smooth bend. These angles, combined with the different lengths of the front and rear legs, produce a rear-to-front incline (front-to-rear decline) of the longitudinal bar. A front cross bar extends between the left and right longitudinal bars near the front of the device, and a rear cross bar extends between the left and right longitudinal bars near the rear of the device. The bars are connected by quick release locks of unique design.

A pipe elbow bracket is connected between the front leg and the longitudinal bar of each side rail. The pipe elbow bracket has one arm welded to the longitudinal bar and extending generally downwardly parallel to the front leg, and another arm welded to the front leg and extending generally parallel to the longitudinal bar. Preferably, the pipe elbow bracket is formed of a single piece of pipe, bent to form the two arms. Another cross bar is adapted to be connected by quick release locks to hubs on the downwardly extending arms or alternatively to hubs on the longitudinally extending arms.

Each leg has a telescoping leg extension. These leg extensions allow the entire exercise device to be raised or lowered in selected increments for different exercises as well as to accommodate different sizes of persons using the exercise device. The adjustable legs also allow either the forward or rearward end of the exercise device to be independently raised or lowered to change the degree of resistance for given exercises that can be formed on the exercise device. Within the range of selected increments of adjustability is a group of leg positions that locate the longitudinal bars in horizontal positions at ballet bar height, thus accommodating traditional ballet exercises.

The aforesaid rear-to-front incline (front-to-rear decline) provides a structural embodiment of an incline-decline principal that is a significant aspect of this invention. According to this incline-decline principal, as incorporated in the structure, this exercise device can accommodate individuals of different physical sizes without changing the exercise and with a common degree of difficulty. The incline-decline principal also allows changes in the degrees of resistance to an exercise depending on how an individual faces the device or where he grasps it to perform an exercise. The advantages and benefits derived from the incline-decline principal can be realized without any adjustments to the exercise device. However, another feature of the invention is that the adjustability of the legs provides for variations in the degree of incline-decline.

A principal object of the invention is to provide an exercise device that is of relatively simple construction, comprising a plurality of bars selectively connected together, and that affords a wide variety of exercises that can be performed by individuals of substantially all sizes and physical conditions.

Another object of the invention is to provide an exercise device that utilizes body weight as the resistance to exercises and that can vary the effect of the body weight resistance without friction, accessory items, or movable parts.

Another object of the invention is to provide an exercise device in the form of an assembly of bars incorporating an incline-decline principle that produces a variation in resistance depending upon the direction an individual faces while performing an exercise.

Another object of the invention is to provide an exercise device that has a few individual bars selectively and releasably connected together and that yet produces a large variety of exercises for virtually all muscles of the body.

Another object of the invention is to provide an exercise device that allows the selective isolation of specific muscles for exercise treatment or alternatively affords a variety of exercises for exercising combinations of muscles simultaneously.

Another object of the invention is to provide an exercise device that utilizes body weight as the resistance during an exercise and that provides for regulating the degree of resistance produced by the body weight over a large range without adjustment of the device and that also provides adjustments for even further expanding that range.

Another object of the invention is to provide an exercise device that is free-standing and does not require attachment to a wall, floor surface, or ladder type stand and yet is extremely stable during the performance of a large variety of exercises.

Another object of the invention is to provide an exercise device that comprises a plurality of bars that can be selectively assembled together by quick release fasteners without the use of tools.

An additional object is to provide such an exercise device that has legs that are adjustable in length with manual operation and without the requirement of tools.

An associated object is to provide such an exercise device comprising a plurality of connected bars that can be quickly disassembled and is portable.

Another object of the invention is to provide an exercise device comprising a plurality of bars selectively assembled together and readily adjustable to conform to the different physical characteristics and sizes of different people, usually with little or no adjustment to the device. More specifically, an object of the invention is to provide such a device having inclined side rails to accommodate different sizes of individuals performing the same exercises and to afford variations in the resistance to a given exercise. A companion object is to provide such an exercise device with means to selectively adjust the degree of incline of the side rails.

Still another object of the invention is to provide an exercise apparatus that has no moving parts and yet provides for a large variety of exercises.

Still another object of the invention is to provide an exercise device that is safe to use.

Still another object of the invention is to provide an exercise device that is of reasonable cost and low maintenance.

Still another object of the invention is to provide an exercise device comprising a plurality of bars that, when assembled together, is aesthetically attractive and appealing.

A further object of the invention is to provide an exercise device that can be effectively used by adults whose physical condition is excellent, by the elderly who are relatively frail, by children, and even by people who are handicapped or have been injured or are otherwise in poor physical condition.

Another object of the invention is to provide an exercise device comprising a plurality of bars that can be used by one or more persons simultaneously.

Another object of the invention is to provide an exercise device that is appealing to children, that can be used by several children simultaneously, and safely, and that can be used indoors.

Another object of the invention is to provide an exercise device that can be used to assist in a wide variety of muscle stretch routines as well as exercises.

Other objects and advantages will be apparent from the drawings, description and claims which follow.

DETAILED DESCRIPTION OF THE PREFERRED EMBODIMENT

Figure 1:
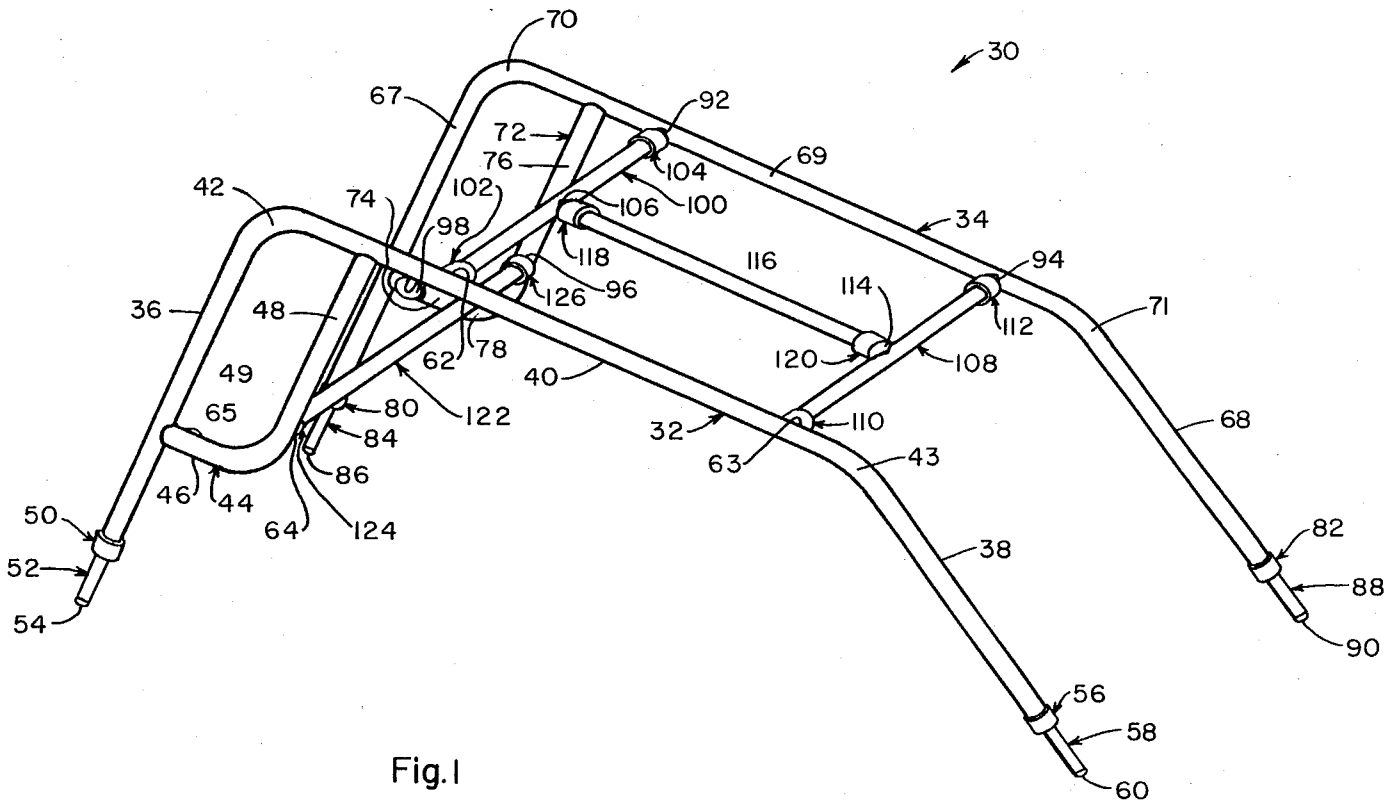
FIG. 1 is a perspective view of the exercise device.
Figure 2:
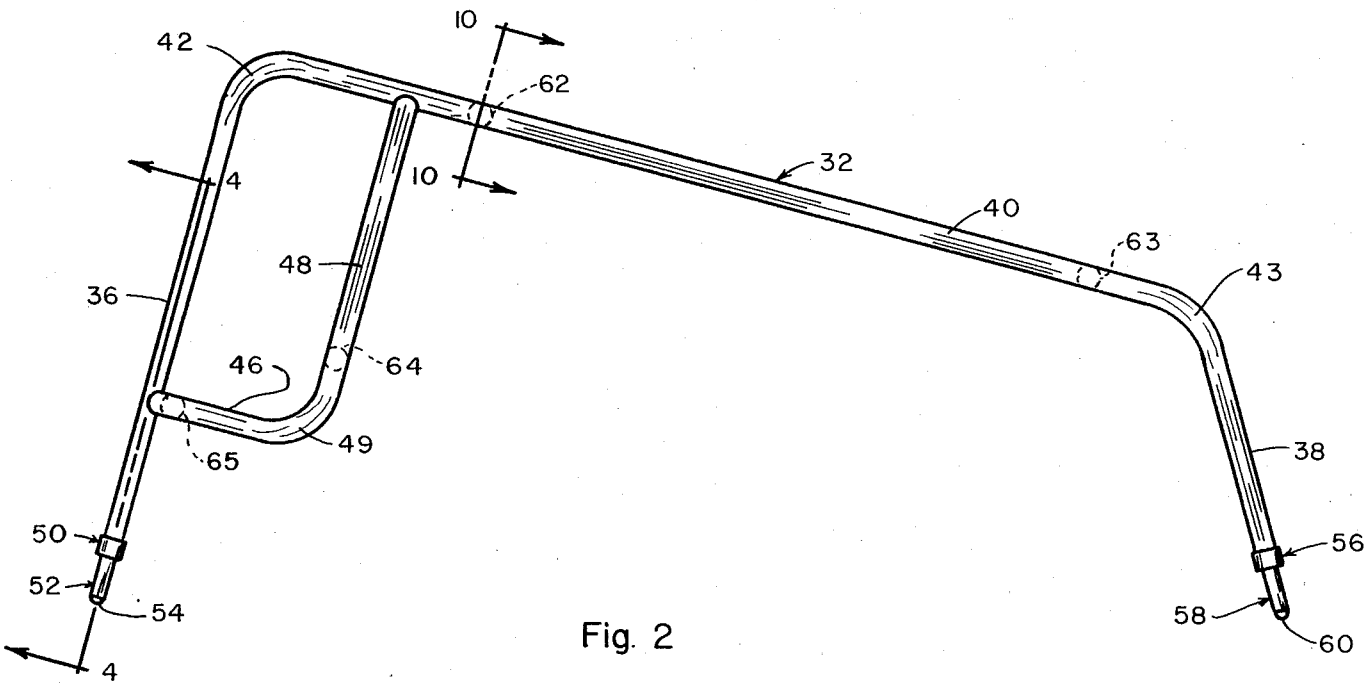
FIG. 2 is a left side elevation view of the exercise device.

This exercise device 30 has a left side rail 32 and a right side rail 34 both formed of hollow steel pipe having a plated outer surface such as nickel plate. Preferably, the pipe has an 0.088 inch wall and an outside diameter of 1 5/16 inch, although variations are possible depending upon the strength and weight desired. The left side rail 32 has a front leg 36, a rear leg 38, and a longitudinal bar or segment 40 extending between the front leg 36 and the rear leg 38. The front leg 36, rear leg 38, and longitudinal bar 40 are preferably formed of a single pipe appropriately bent. The front leg 36 and the longitudinal bar 40 intersect at a rounded corner 42 and define an angle between them of approximately 90°. The corner 42 is on a radius of about 3½ inches. The rear leg 38 and the longitudinal bar 40 intersect at a rounded corner 43 also bent on a radius of about 3½ inches. The rear leg 38 and the longitudinal bar define an angle between them of about 120°. The front leg is about 29 inches long, the rear leg about 22 inches long, and the longitudinal bar about 51 inches long. While these dimensions may be varied, it will become apparent that they combine proportionally with the dimensions of other components and with various angles to produce an exercise device that can be used in many ways by various sized individuals, and is sturdy and safe throughout all uses.

A pipe elbow bracket 44, preferably of single piece construction, has an arm 46 welded to the front leg 36 and another arm 48 welded to the longitudinal bar 40. The pipe elbow 44 is preferably made of plated hollow steel pipe of the same specifications as the side rails 32 and 34. The arm 46 and the arm 48 intersect at a rounded corner 49 formed on about a 3½ inch radius, and the angle defined by the arm 46 and the arm 48 is about 90°. The arm 46 is generally parallel to and spaced about 19 inches below the longitudinal bar 40, and the arm 48 is generally parallel to and spaced about 8¾ inches rearward of the front leg 36.

At the bottom of the front leg 36, there is a slip lock 50 which will be described in more detail hereinafter. A leg extension 52, which is made of plated hollow steel pipe, is received within the leg 36 and is axially slidable therein. The slip lock 50 can permit the leg extension 52 to be adjusted axially within and relative to the leg 36 and can lock the leg extension 52 in any one of several selected positions. A resilient foot 54 is fitted into the bottom of the leg extension 52. The resilient foot 54 may be made of any non-skid material, such as neoprene, and may have a convex lower surface, as shown.

At the lower end of the rear leg 38, there is another slip lock 56 which is identical to the slip lock 50. A leg extension 58 is axially slidable within the rear leg 38. The leg extension 58 has a resilient foot 60 fitted into its lower end identical to the foot 54 in the front leg 36. The leg extension 54 may be identical to the leg extension 52, and the slip lock 56 allows the leg extension to be locked in any one of several axially adjustable positions within the rear leg 38.

On its right side facing laterally, the left side rail 32 has four hubs 62, 63, 64 and 65. The construction of these hubs 62, 63, 64 and 65 will be described in detail in conjunction with the description of FIGS. 6 through 10. Two of these hubs 62 and 63 are located on the longitudinal bar 40. The center of the forward hub 62 is approximately 13 inches rearward of the front leg 36 while the center of the rearward hub 63 is approximately 32 inches rearward of the front leg 36. The third hub 64 is located on the arm 48 of the pipe elbow bracket 44, positioned about 15 inches below the longitudinal bar 40. The remaining hub 65 is on the arm 46 of the pipe elbow bracket 44 positioned rearwardly of the front leg 36 a distance of about 1 inch.

The right side rail 34 is essentially a mirror image of the left side rail 32 and is preferably of the same material and of the same dimensions as the left side rail 32. Thus, the right side rail 34 has a front leg 67, a rear leg 68, and a longitudinal bar 69 is connected between the front leg 67 and the rear leg 68. The corner 70 between the front leg 67 and the longitudinal bar 69 is represented by a smooth bend of the pipe on a radius of about 3½ inches. The angle between the front leg 67 and the longitudinal bar 69 is approximately 90°. A smooth bend 71 is also formed at the intersection between the rear leg 68 and the longitudinal bar 69. The angle between the rear leg 68 and the longitudinal bar 69 is approximately 120°. The bend 71 is also formed on a radius of about 3½ inches.

A pipe elbow bracket 72, like the pipe elbow bracket 44, is formed of plated hollow pipe. The pipe elbow bracket 72 has an arm 74 the forward end of which is welded to the front leg 67 and an arm 76 the upper end of which is welded to the longitudinal bar 69. The arms 74 and 76 are joined at a smooth bend 78 formed on a radius of about 3½ inches. The angle defined by the arms 74 and 76 is approximately 90° with the arm 74 being about 19 inches below and parallel to the bar 69 and the arm 76 about 8¾ inches rearward of and parallel to the front leg 67. At the lower end of the front leg 67, there is a slip lock 80, and at the lower end of the rear leg 68, there is a slip lock 82; the slip locks 80 and 82 are identical to the slip locks 50 and 56. A leg extension 84 is axially slidable within the front leg 67. The leg extension 84 has a resilient foot 86 fitted in its lower end. Another leg extension 88 is slidably received within the rear leg 68. The leg extension 88 has a resilient foot 90 fitted in its lower end.

The right side rail 34 has four hubs 92, 94, 96 and 98 on its left side facing laterally. The hub 92 corresponds to the hub 62 on the left side rail 32 and is approximately 13 inches rearward of the front leg 67. The hub 94 corresponds to the hub 63 and is approximately 32 inches rearward of the front leg 67. The hub 96 corresponds to the hub 64 and is approximately 15 inches below the longitudinal bar 69. Finally, the hub 98 corresponds to the hub 65 and is positioned on the arm 74 approximately one inch rearward of the front leg 67.

Figure 3:
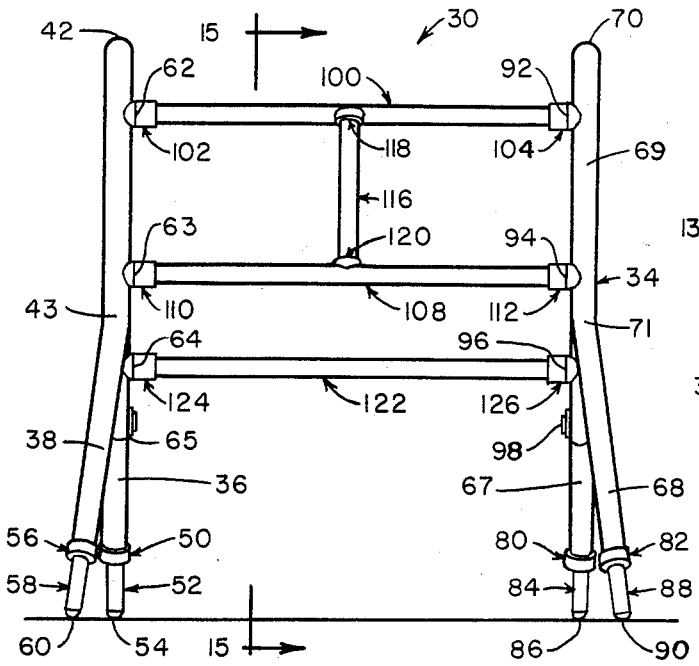
FIG. 3 is a rear elevation view of the exercise device.

Preferably, as shown in FIG. 3, the front leg 36 and longitudinal bar 40 may define a plane with the rear leg 38 extending laterally outwardly from the bend 43 at an angle of about 8° to that plane. In such a modification, the rear leg 68 of the right side rail 34 also would be turned outwardly at the same angle. This divergence of the rear legs 38 and 68 adds stability to the exercise device 30.

A front cross bar 100 is connected between the two hubs 62 and 92 of the left and right side rails 32 and 34. This connection is by two quick release locks 102 and 104 which will be described in detail hereinafter in conjunction with the description of FIGS. 6 through 10. The cross bar 100 has a hub 106 at its center extending generally rearwardly.

A rear cross bar 108 extends between the hubs 63 and 94 of the left and right side rails 32 and 34. The rear cross bar 108 is connected by two quick release locks 110 and 112, also to be described hereinafter. A generally forwardly projecting hub 114 is located at the center of the rear cross bar 108.

A central longitudinal bar 116 is adapted to extend between the hub 106 on the front cross bar 100 and the hub 114 on the rear cross bar 108. The central longitudinal bar 116 can be connected to the hub 106 by a quick release lock 118 and to the hub 114 by a quick release lock 120, the locks 118 and 120 being similar to the quick release lock 102 which is yet to be described in detail.

A lower cross bar 122 is adapted to fit either between the hubs 64 and 96 or the hubs 65 and 98 on the pipe elbow brackets 44 and 72. The lower cross bar 122 is connected by quick release locks 124 and 126 (like the quick release lock 102) at its opposite ends.

It should be noted that the cross bars 100 and 108, the central longitudinal bar 116, and the cross bar 122 are all preferably of the same pipe material as the side rails 32 and 34. Also, the four bars are each about 32 inches long. Thus, the cross bars 100 and 108 are interchangeable and the central longitudinal bar 116 and the cross bar 122 are interchangeable.

Figure 4:
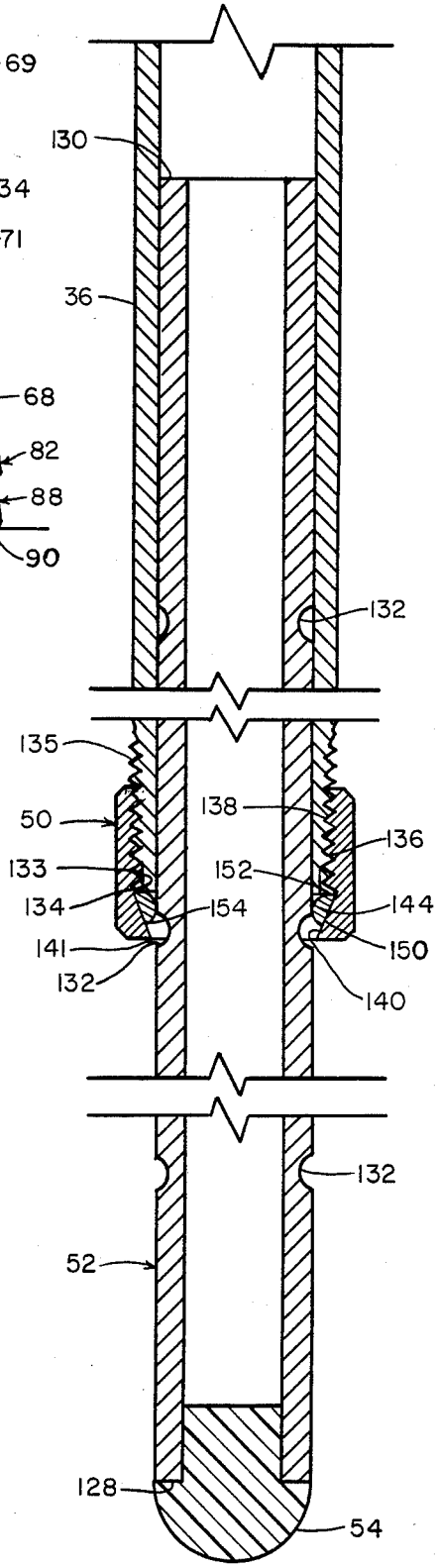
FIG. 4 is an enlarged view in section, partially broken away, viewed along the line 4—4 of FIG. 1, illustrating a leg extension and slip lock assembly.
Figure 9:
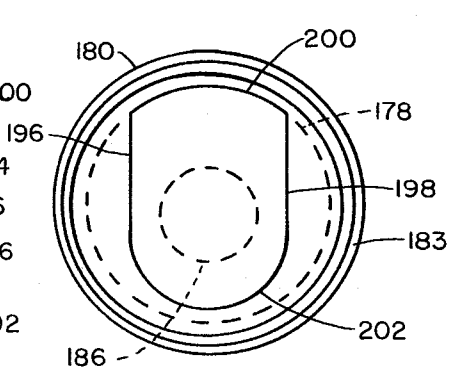
FIG. 9 is a front elevation view of the lug and collar of FIG. 8.
Figure 8:
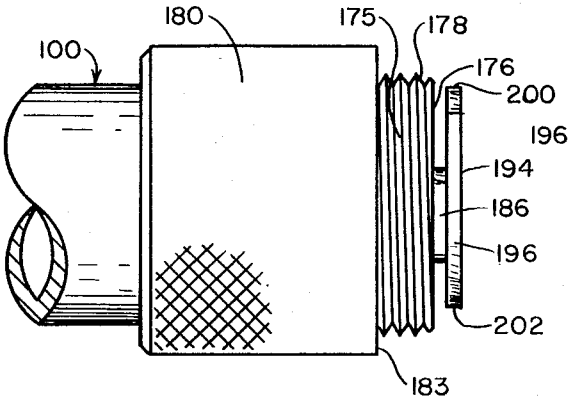
FIG. 8 is a side elevation view of a lug and collar on the end of a bar.

FIG. 4 illustrates the relationship between the front leg 36 and the leg extension 52 that is telescoped within the leg 36, and particularly shows the slip lock 50 at the lower end of the front leg 36. This illustration in FIG. 4 and the description of it apply also to the other legs 38, 67 and 68 and their respective slip locks 56, 80 and 82. As shown, the leg extension 52 has a lower end 128 and an upper end 130. The diameter of the leg extension 52, which is preferably about one inch, allows it to be slidably received within the front leg 36. The leg extension is preferably about 20 inches long. It has a plurality (preferably 6 in number) of annular grooves 132 in its outer wall at spaced intervals of about three inches. These annular grooves may be of any shape, but preferably are arcuate in cross-section, as illustrated, with a width of about 0.130 inch and a depth of about 0.040 inch.

Figure 5:
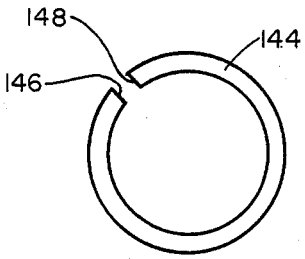
FIG. 5 is a top plan view of a typical snap ring used in the slip lock assembly.

At the lower end of the leg 36, there is a short cylindrical section 133 terminating at its lower end in an annular face 134. At its upper end, the short cylindrical section terminates at a threaded section 135. The diameter of the short cylindrical section 133 is equal to or slightly less than the minimum diameter of the threaded section 135. A collar 136, preferably having a knurled outer surface between chamfered edges, has internal threads 138 by which the collar 136 can be threaded onto the threaded section 135 of the leg 36. Within the collar 136 at its lower end, there is an annular beveled surface 140 terminating at an inner circular edge 141. The internally threaded section 138 terminates at the annular beveled surface 140 to create a stop for a compression ring 144. The compression ring 144, which is preferably of tempered spring steel, bears against the lower end of the threaded section 138. As shown in FIG. 5, the compression ring 144 has spaced ends 146 and 148 creating a gap that allows the snap ring 144 to be compressed from a normally expanded condition, as illustrated, to a compressed condition of reduced diameter.

The compression ring 144 has a beveled outer surface 150 that is opposed to the beveled surface 140 on the inner wall of the collar 136. A top annular edge 152 on the compression ring 144 is opposite to and in the path of the lower end 134 of the leg 36. The compression ring 144 has an inner surface 154 that is convex in cross section, generally complementary in shape to the grooves 132, except the compression ring is narrower by as much as 0.020 inch to assure avoidance of friction with the grooves 132. Therefore, the compression ring 144 fits freely within any one of the annular grooves 132 in the leg extension 52 upon compression of the compression ring 144. Since the beveled outer surface 150 of the compression ring 144 is positioned against the beveled surface 140 of the collar 136 and because the ring 144 is always at least slightly compressed against the beveled surface 144, when the collar is threaded away from the leg 36, the ring 144 will slide upwardly (and expand outwardly) until the annular face 134 contacts and stops against the beginning of the threaded section 138. In that position, the innermost diameter of the compression ring 144 is greater than the outer diameter of the leg extension 52.

As FIG. 4 illustrates, when the collar 136 is rotated in a direction to thread it away from the leg 36, the beveled surface 140 moves away from the annular face 134. This lets the resilience of the compression ring 144 bias the ring 144 outwardly because it is gradually less restricted by pressure from the beveled surface 140. As thus outwardly expanded, the inner convex surface 154 is withdrawn from the annular groove 132, and the leg extension 52 is free to slide axially within the leg 36.

To use the slip lock 50 to lock the leg extension 52 in a selected position, it is slid axially until a selected one of the grooves 132 is opposite the inner convex surface 154 of the compression ring 144. The inner circular edge 141 at the lower end of the annular beveled surface 140 of the collar 136 is slightly larger in diameter than the outer diameter of the leg extension 52. Also, the fit between the threads 135 and the threads 138 is somewhat loose, so the collar 136 is normally not concentric with the leg 36. As a result, the axis of the leg extension 52 is normally at a slight angle to the axis of the collar 136. This offset causes a small edge segment of the annular detent 154 to "feel" each groove 132 as the leg extension 52 is adjusted axially, making it easy to locate the desired groove 132. This "feel" occurs even though the position of the collar 136 is such that the innermost diameter of the compression ring surface 154 is slightly greater than the outer diameter of the leg extension 54. When the selected groove 132 is positioned opposite the convex surface 154, the collar 136 is threaded upward on the threaded section 135 of the leg 36. This moves the annular beveled surface 140 upwardly, but the position of the upper face 152 of the ring 144 against the lower face 134 of the leg 36 prevents the ring 144 from moving upwardly. Further threading of the collar 136 draws the beveled surface 140 across the beveled surface 150 of the compression ring 144, compressing the ring 144 to a reduced diameter and pressing the annular convex surface 154 into the groove 132. When the collar 136 is tightened, the ring 144 seats within the groove 132 and the leg extension 52 is firmly locked in place.

Figure 7:
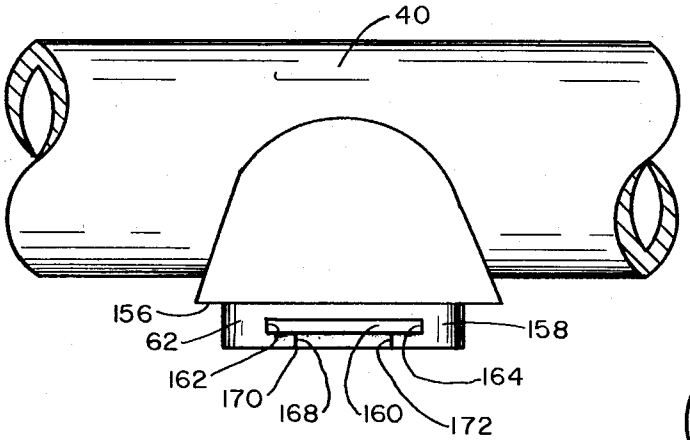
FIG. 7 is a top plan view of the hub of FIG. 6.
Figure 6:
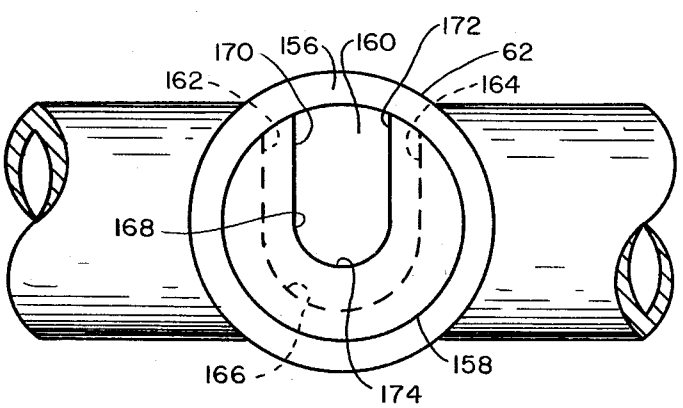
FIG. 6 is an enlarged front elevation view of a typical hub that is part of a quick release lock.

FIGS. 6 through 10 illustrate the construction and function of a quick release lock 102. These figures and their description would apply equally to the other quick release locks 104, 110, 112, 118, 120, 124 and 126. As shown in FIGS. 6 and 7, the hub 62 is welded to the bar 40. The hub 62 has an annular shoulder 156 from which a cylindrical stub 158 projects. There is a vertical recess 160 in the cylindrical stub 158. The recess 160 has straight side walls 162 and 164, a concave bottom 166, and is open at the top. A slot 168 communicates with the recess 160. The slot 168 is defined by straight side walls 170 and 172 that are spaced inwardly of the side walls 162 and 164 of the recess 160. The lower end of the slot 168 is defined by a round bottom wall 174.

Figure 10:
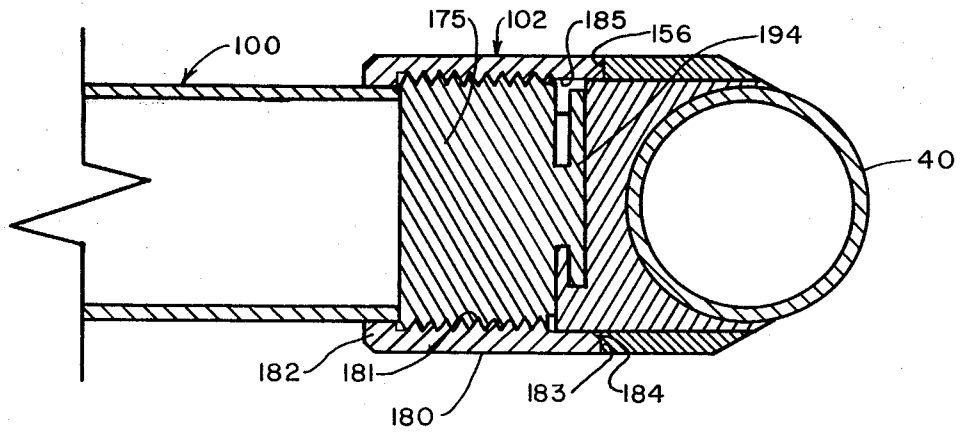
FIG. 10 is an enlarged view in section of a quick release lock viewed along the line 10—10 of FIG. 2.

As shown in FIG. 10, a block 175 is welded to the end of the bar 100. The block 175 has an end face 176 and a threaded section 178 adjacent the end face 176. The diameter of the threaded section 178 is greater than the diameter of the bar 100 and is slightly less than the maximum diameter of the threaded sections 178 and 181. A knurled collar 180 has internal threads 181 by which the collar 180 is threaded onto the threaded section 178. Beyond the block 175, the threads 181 terminate and the collar has a sleeve section 182 that slides on the bar 100 and is of smaller diameter than that of the threaded section 178 to prevent removal of the collar 180 from the bar 100. At its other end, the collar 180 has a flat annular side wall 183. The annular side wall 183 has a beveled inner edge 184. Adjacent the beveled edge 184, there is a cylindrical sleeve portion 185 the diameter of which is slightly greater than the diameter of the cylindrical stub 158.

A stud 186 projects from the end face 176. The diameter of the stud 186 is slightly less than the width of the slot 168 between the side walls 170 and 172. The radius of the stud 186 is substantially the same as the radius of the bottom wall 174 defining the slot 168.

A lug 194 extends outwardly from the short stud 186. The lug 194 has straight side walls 196 and 198 that the diverge slightly in an upward direction. The average width of the lug 194 is slightly less than the width of the recess 160. The lug 194 has a curved top wall 200, and a curved bottom wall 202. The radius of the top wall 200 is about the same as the radius of the cylindrical stub 158. The radius of the bottom wall 202 is substantially equal to the radius of the bottom surface 166 of the recess 160.

The bar 100 is locked to the bar 40 by positioning the lug 194 over the recess 160. Because the bottom surface 202 of the lug 194 is rounded, the lug 194 is generally self-aligning to the side edges 162 and 164 of the recess 160. When the bar 100 is lowered, the lug 194 slids downwardly in the recess 160 with the lateral sides 196 and 198 contacting the sides 162 and 164 of the recess and blocked from escape by the side walls 170 and 172 that define the slot 168. Because of the slight divergence of the sides 196 and 198 of the lug 194, there is a slight tightening effect as the lug 194 reaches the bottom of the recess 160. When the lug 194 has bottomed against the bottom wall 166 of the recess 160, the bar 100 will be substantially co-axial with the cylindrical stub 158. At this time, the collar 180 can be rotated on the block 175, advancing the cylindrical sleeve portion to and over the cylindrical stub 158, the beveled edge 184 acting to properly align the parts. Threading of the collar 180 is continued until its side wall 182 is tightened against the annular shoulder 156, firmly locking the bar 100 to the bar 40.

To use this exercise device 30, it is now apparent that the bars can be assembled in various ways. The most common assembly is to install the front cross bar 100 between the hubs 62 and 92 and the rear cross bar 108 between the hubs 63 and 94. These connections can be done quickly because of the quick release locks 102, 104, 110 and 112. The specific way of operating these locks has been described heretofore.

For some exercises the central longitudinal bar 116 is used. For others it is removed. Again, the quick release locks 118 and 120 permit installation and removal of the bar 116 to be done quickly without any tools.

If the lower cross bar 122 is to be used, it may be installed between the hubs 64 and 96 or alternatively between the hubs 65 and 98. The quick release locks 124 and 126 likewise permit the installation and removal of the lower cross bar 122 to be done quickly and without the use of tools. It should be noted that in all cases, the cross bars and longitudinal bar 116 will not rotate once they are installed. This is because of the flat side walls 162 and 164 of the recess 160 which engage the flat side walls 196 and 198 of the lug 194.

The exercise device 30 can be raised or lowered for different exercises, for different physical sizes of individuals using the device, and for varying the resistance and/or degree of difficulty of an exercise. Also, the front or rear ends of the device 30 can be raised or lowered independently. These adjustments are possible because of the leg extensions 52, 58, 84 and 88 which can be alternately released or locked in place by the slip locks 50, 56, 80 and 82 respectively. The operation of the slip locks has also been described in conjunction with FIGS. 4 and 5.

This exercise device 30 can be used for a large variety of different exercises and stretch routines. Even though these might be listed, individuals using the exercise device could discover new ways to use it to meet their particular exercise needs. Therefore, the exercises illustrated in FIGS. 11–21 and the stretch routines illustrated in FIGS. 22–25 are only examples representing a few of the many variations on ways the exercise device 30 may be used.

Figure 11:
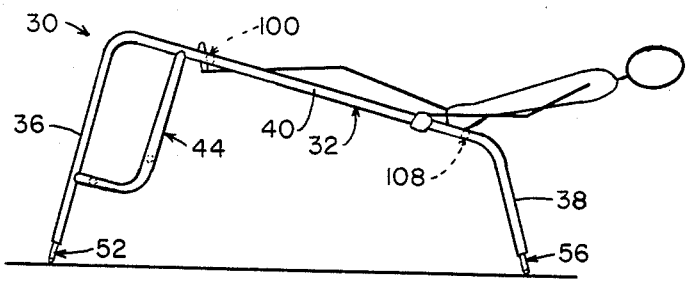
FIG. 11 is a side elevation view of the exercise device illustrating its use for a sit-up exercise.

FIG. 11 illustrates not only an exercise but a series of variations on that exercise. The exercise shown in FIG. 11 is the traditional sit-up exercise. As specifically shown, an individual is seated on the rear cross bar 108 with his feet hooked under the front cross bar 100. (Alternatively, particularly if the individual's legs are short, one foot may be hooked under the central longitudinal bar 116 and the other foot hooked under a side longitudinal bar 40 or 69.) This puts the feet higher than the thighs, making the sit-up exercise more difficult than if the individual were in a horizontal position because the resistance caused by the individual's body weight is increased. This exercise also illustrates some advantages of the adjustability of the exercise device. If the sit-up exercise is to be made more difficult, the leg extensions 52 (and 84) can be extended to raise the front legs 36 (and 67) to increase the incline angle of the longitudinal side bars 40 (and 69). This further increases the effective resistance of the body weight. On the contrary, to make the sit-up exercise easier, the leg extensions 52 (and 84) can be left contracted, and the leg extensions 58 (and 88) can be extended, raising the rear legs 38 (and 68).

The exercise of FIG. 11 also shows an advantage of the longitudinal side bars 40 and 69. The individual is shown grasping the longitudinal side bar 40 with his left hand (his right hand might similarly be grasping the other longitudinal side bar 69). This lets the individual use as much manual assistance as he need or desires as he does the sit-up exercise. Alternatively, the exercise can be performed without such manual assistance.

This exercise device also allows less difficult sit-up exercises to be performed. The individual could reverse his position and sit on the front cross bar 100 with his feet hooked under the rear cross bar 108. This would position the user's feet below a horizontal plane, as the exercise is performed. Thus, FIG. 11 illustrates a variety of variations of a well-known exercise, all using the individual's body weight as the resistance, each representing a variation on that resistance.

It may be noted that cushions may be provided for attachment to the cross bars. Such cushions could be used for an exercise during which an individual would sit on one of the cross bars. These cushions would be attachable and removable without requiring removal of the cross bars.

Figure 12:
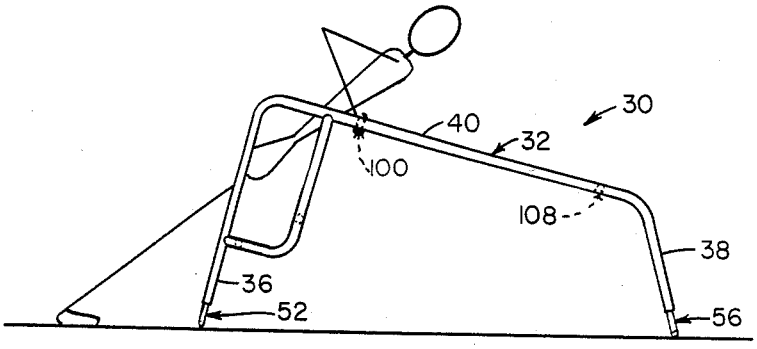
FIG. 12 is a side elevation view of the exercise device illustrating its use for a push-up exercise.
Figure 13:
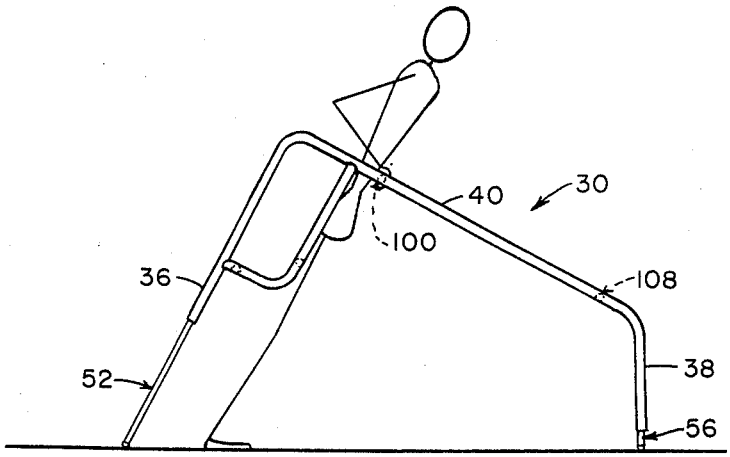
FIG. 13 is a side elevation view of the exercise device with the front legs extended, illustrating a variation of a push-up exercise.

FIGS. 12 and 13 illustrate two variations of a push-up. In FIG. 12, the leg extensions 52 and 56 of the exercise device 30 are fully telescoped so that the device is in its lowest position. The user has faced the forward end of the exercise device with his hands grasping the front cross bar 100, palms down. Using his arms, the individual will push himself away from the cross bar 100 and lower himself back to the cross bar 100, repeating for each push-up. This exercise can be varied by repeating the same thing, but with the palms facing up instead of down. Another variation would be to grasp the longitudinal bars 40 (and 69) with the right and left hands and repeat the push-ups. In the latter exercise, the degree of difficulty can be varied. If the front cross bar 100 is removed, the hands can be slid down the longitudinal side bars 40 and 69 toward the rear end of the exercise device. This will move the individual toward a more horizontal position, making the push-up exercise more difficult because of the increased leverage of the individual's weight opposing the push-up.

In FIG. 13, a variation of the push-up exercise is illustrated. In this case, the front leg extensions 52 and 84 have been extended to raise the height of the front cross bar 100. This makes the push-up more of a push-away exercise, and easier to perform. Thus, FIGS. 12 and 13 illustrate variations of another exercise that are possible with this exercise device.

Figure 14:
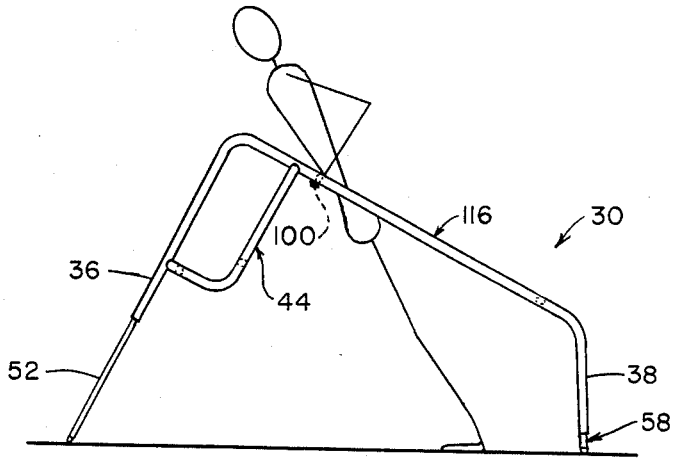
FIG. 14 is a side elevation view of the exercise device illustrating still another variation of the push-up exercise.

FIG. 14 illustrates still another variation of the push-up exercise with the individual inside the exercise device 30 and facing forwardly, again using the cross bar 100 as the push bar. Note the front legs 36 (and 67) may be raised for this exercise as desired to vary the degree of difficulty, and to accommodate different sizes of individuals.

Figure 15:
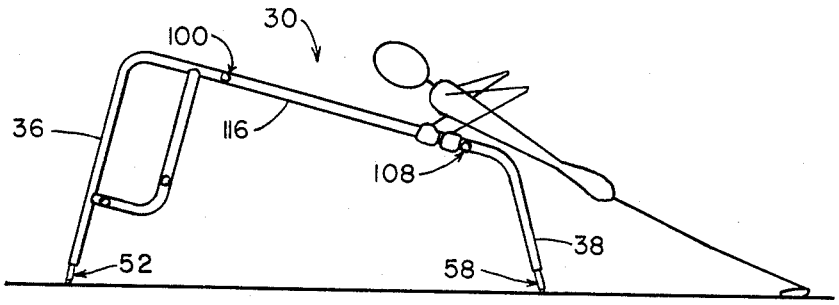
FIG. 15 is a view in section of the exercise device on a reduced scale, such as taken along the line 15—15 of FIG. 3, illustrating a stacked-hand push-up exercise performed on the central longitudinal bar.

FIG. 15 illustrates another variation of a push-up exercise performed on the central longitudinal bar 116. As shown in FIG. 14, the individual's hands are grasping the central longitudinal bar 116, one hand above the other one. The individual's body is stretched out so that he can push away from the bar 116 and alternately lower himself back to the position shown in FIG. 14. This exercise applies more strain to and exercises one arm more than the other arm. Alternatively, after several of these push-ups, the individual can reverse the positions of his hands, and repeat the push-up exercise. The degree of difficulty can be varied depending upon where along the length of the bar 116 the individual places his hands. The higher on the bar, the easier the exercise.

This exercise device 30 permits many variations that individuals may create themselves. For example, another variation of the push-up (not illustrated) can be performed with the device in the lowest position and the individual standing at the right rear corner of the exercise device 30. He places his right hand on the right end of the rear cross bar 108 and his left hand on the longitudinal side bar 69 forward of the rear cross bar 108. In this position, the individual lowers his chest to his hands and pushes himself away, alternating these motions for a variation of the push-up. This exercise can be reversed at the left rear corner of the exercise device 30.

Figure 16:
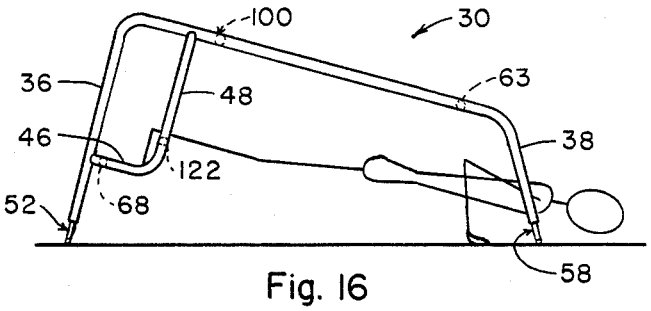
FIG. 16 is a side elevation view of the exercise device illustrating a different form of a push-up exercise.

A more difficult variation of the push-up is illustrated in FIG. 16. For this exercise, the rear cross bar 108 and the central longitudinal bar 116 will have been removed. In the exercise illustrated in FIG. 15, the individual has his feet hooked over the lower cross bar 122 located at the hubs 64 (and 96). To reduce the difficulty of this exercise, the bar 122 can be moved and locked between the hubs 65 and 98 on the arms 46 and 74. Alternatively, to raise the feet and make the exercise more difficult, the feet can be hooked over the front cross bar 100 with the hands pressed against the floor.

It will be appreciated that various pull-ups can be done by an individual lying on his back and grasping either one of the cross bars 100, 108 or 122 or the longitudinal side bars 40 and 69. These variations allow the individual to strain more or less during pull-up exercises. Also, with the lower cross bar 122 in either of its two locations, a child can do pull-up exercises. Again, variations are possible by adjusting the lengths of the legs using the leg extensions 52, 58, 84 and 88.

To do a pull-up exercise with uneven strain on the arms, the individual can lie sideways to the device 30, grasping either the central longitudinal bar 116 or either of the longitudinal side bars 40 or 69. This will strain the arm reaching higher. The procedure can be reversed by the individual turning around and lying in the opposing direction to maximize the exercise to the other arm.

Figure 17:
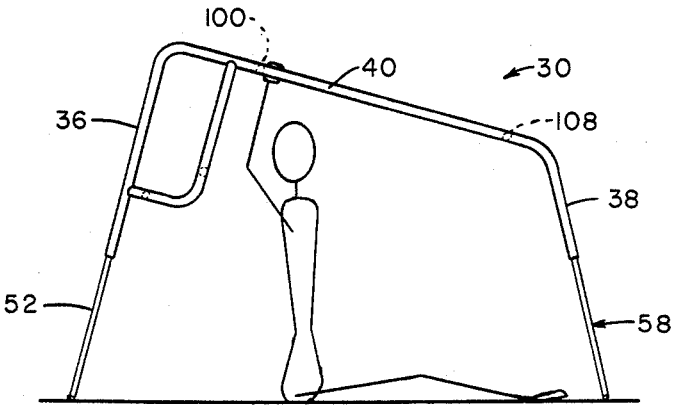
FIG. 17 is a side elevation view of the exercise device with both front and rear legs fully extended for a pull-up exercise.

FIG. 17 illustrates an exercise done with all the leg extensions 52, 58, 84 and 88 fully extended, raising the exercise device 30 to its maximum height. The individual is seated underneath the device 30 between the side rails 32 and 34, facing rearwardly. He grasps the longitudinal bars 40 (and 69) slightly behind his head. He then pulls upwardly, with his arms raising his body. The incline of the longitudinal bars 40 and 69 allows them to be selectively grasped at different points to change the difficulty of the exercise and also accommodate individuals of different physical sizes.

Figure 18:
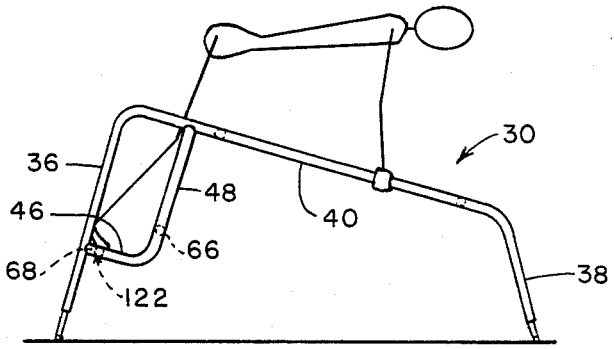
FIG. 18 is a side elevation view of the exercise device illustrating an exercise for leg muscles.

FIG. 18 illustrates an exercise for the calf muscles. The lower side bar 122 is positioned on the hubs 65 and 98. The individual is standing with the balls of his feet on the cross bar 122. With his hands, he grasps the longitudinal side bars 40 and 69, or one side bar and the central longitudinal bar 116. He then alternates between raising his heels as illustrated in FIG. 17 to lowering them below the cross bar 122. The exercise can be varied by pivoting the feet outwardly and varied still further by pivoting the feet inwardly, and in each position repeating the exercises.

Figure 19:
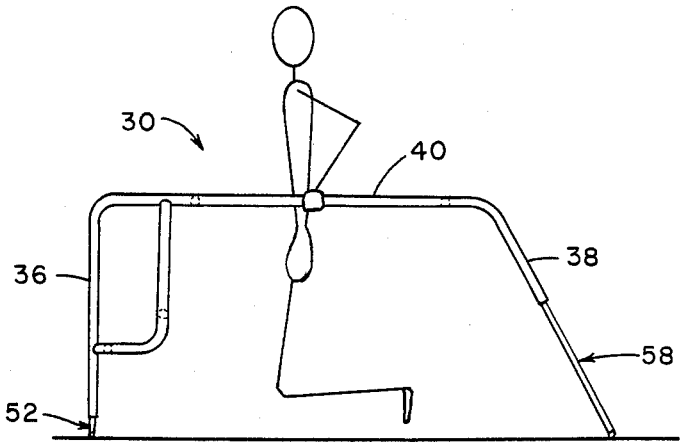
FIG. 19 is a side elevation view of the exercise device with the rear legs extended to put the longitudinal rails generally horizontal for a dip exercise.

FIG. 19 illustrates an exercise performed with the longitudinal side bars 40 and 69 in a horizontal position. This can be accomplished by extending the leg extensions 58 and 88 to their maximum. In this exercise, the individual has stood between the central longitudinal bar 116 and one of the longitudinal side bars, such as the bar 40, grasping them with his two hands. He then lifts his feet off the floor and uses his arms to raise and lower his body without touching the floor.

Figure 20:
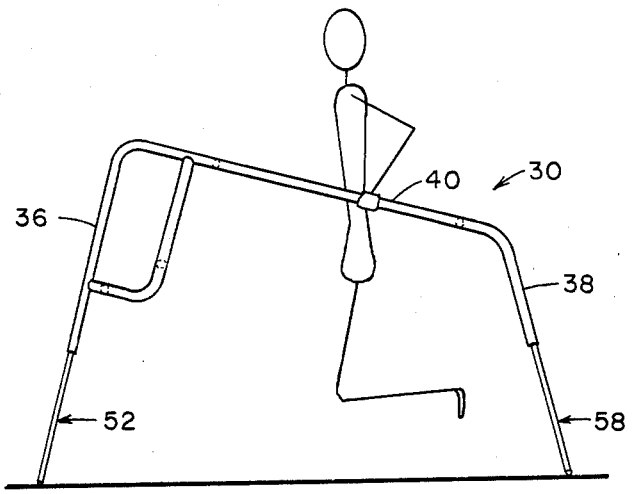
FIG. 20 is a side elevation view of the exercise device illustrating the exercise device in an incline-decline configuration for a variation of the dip exercise.

FIG. 20 illustrates how the incline-decline principal can be applied to the exercise of FIG. 19. In FIG. 20, the front legs 36 and 67 have been raised to establish an incline-decline.

Figure 21:
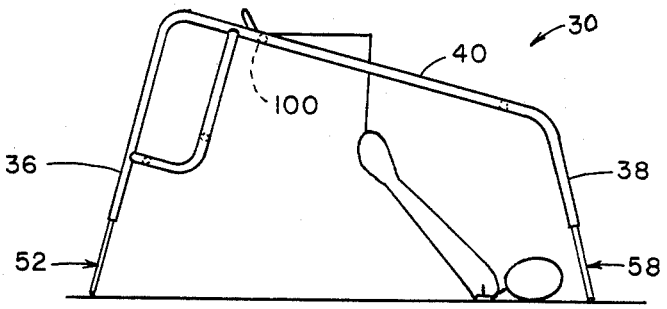
FIG. 21 is a side elevation view of the exercise device illustrating a leg exercise.

FIG. 21 illustrates another exercise for the legs. With his ankles hooked over the cross bar 100, the individual uses his legs to raise and lower his torso.

Figure 22:
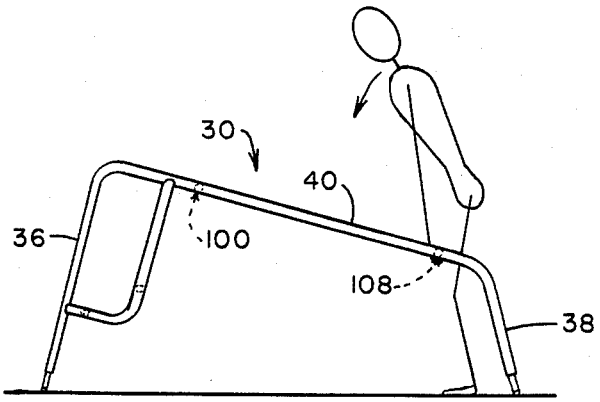
FIG. 22 is a side elevation view of the exercise device illustrating an arm stretch exercise.
Figure 23:
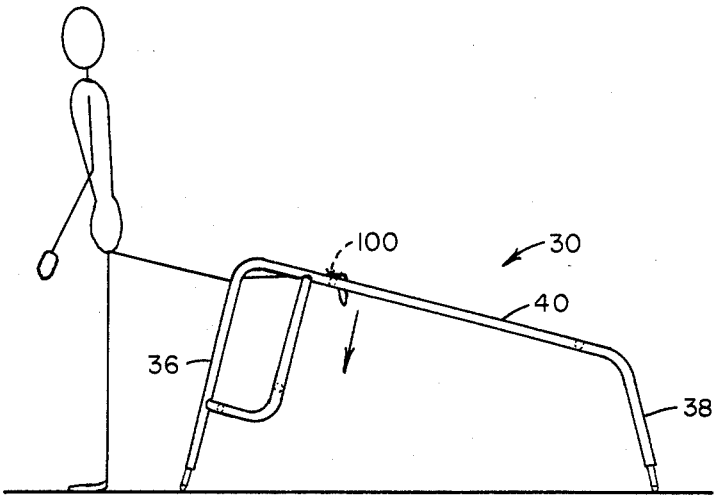
FIG. 23 is a side elevation view of the exercise device illustrating a leg stretch exercise.
Figure 24:
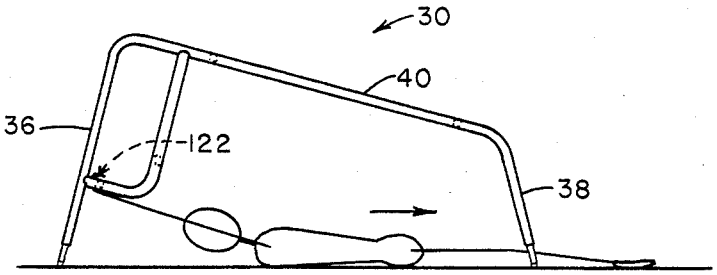
FIG. 24 is a side elevation view of the exercise device illustrating another form of arm stretch exercise.
Figure 25:
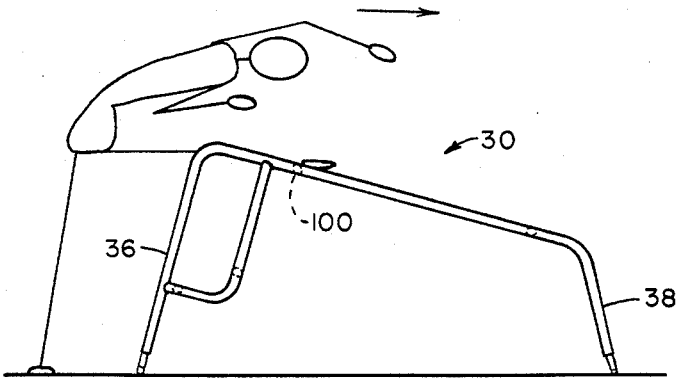
FIG. 25 is a side elevation view of the exercise device illustrating a leg and arm stretch exercise.

FIGS. 22–25 illustrate a few of the many stretch routines that can be performed with the aid of this exercise device. In FIG. 22, the individual grasps the rear cross bar 108 and leans forward, stretching his arms. In FIG. 23, a leg, hooked over the cross bar 100 is pushed downwardly, stretching the leg. In FIG. 24, while grasping the cross bar 122, the individual slides his body rearwardly, stretching the arms. In FIG. 25, the individual is standing sideways to the device 30 with a leg over the bar 100 at the ankle. The individual leans toward the elevated leg and extends his upper arm toward the elevated foot.

These few examples are adequate to illustrate the versatility of this exercise device 30. Those skilled in the art will recognize many other exercises, and varieties of them, that can be performed to exercise virtually all muscles of the body.

The exercise device 30 which has been illustrated and described heretofore clearly meets the needs and objectives of this invention. However, these drawings and the description represent preferred embodiments of the invention, but are not to be deemed to be limiting inasmuch as persons skilled in the art will recognize the scope of the invention does incorporate other modifications and variations, all of which are intended to be encompassed with the scope of the claims which follow.

What is claimed is:

1. An exercise device comprising left and right side rails each having a front leg, a rear leg, and a longitudinal rail and further comprising a central longitudinal bar joined to the side rails in a position not higher than the plane of said left and right side rails, the front leg extending further upwardly than the rear leg to thereby put the longitudinal rail on an incline downward from the front leg toward the rear leg, a front cross bar having left and right ends, means to releasably connect the left end of the front cross bar to the left side rail, means to releasably connect the right end of the front cross bar to the right side rail, a rear cross bar having left and right ends, means to releasably connect the left end of the rear cross bar to the left side rail, and means to releasably connect the right end of the rear cross bar to the right side rail.

2. The exercise device of claim 1 wherein the front leg and the longitudinal rail define an angle between about 80° and about 100° and the rear leg and the longitudinal bar define an angle between about 110° and about 130°.

3. The exercise device of claim 2 wherein the front leg and the longitudinal rail define a plane and the rear leg extends laterally outwardly from the plane at an angle between about 5° and about 10°.

4. The exercise device of claim 1 including a bracket on each side rail extending between the front leg and the longitudinal rail, and a third cross bar having left and right ends, means to releasably connect the left end of the third cross bar to the left side bracket, and means to releasably connect the right end of the third cross bar to the right side bracket.

5. The exercise device of claim 4 wherein each releasable connecting means includes a fitting on the side rail, each bracket having at least two spaced fittings.

6. The exercise device of claim 1 wherein said central longitudinal bar has a front end and a rear end, means to releasably connect the front end of the central longitudinal bar to the front cross bar, and means to releasably connect the rear end of the central longitudinal bar to the rear cross bar.

7. The exercise device of claim 1 wherein each connecting means comprises a fitting on the side rail and a fitting on the end of a cross bar, a first one of the fittings comprising means defining a face, a lug having lateral wings spaced from the face, the second fitting comprising means defining a wall, a vertical slot in the wall open at the top and closed at the bottom for receiving the lug, and means behind the wall defining recesses adjacent the sides of the slot for receiving the lateral wings of the lug.

8. The exercise device of claim 7 wherein the sides of the wings are flat and the sides of the recesses are flat to prevent rotation of the fittings relative to one another.

9. The exercise device of claim 7 including a cylindrical collar threaded onto the first fitting to enable the collar to be tightened against the second fitting and block release of the lug from the slot.

10. The exercise device of claim 9 including means defining an annular shoulder on the second fitting, the collar having an end facing and adapted to abut the annular shoulder when the collar is threaded on the first fitting.

11. The exercise device of claim 1 including a leg extension telescopingly received within each leg, and means to releasably lock the leg extension in a selected position relative to the leg.

12. The exercise device of claim 11 wherein each locking means comprises a collar threaded onto the end of a leg, an annular compression ring positioned within the collar in the path of the end of the leg, the compression ring being of resilient material and having a gap allowing the compression ring to be compressed to a reduced diameter, a beveled surface on the inner side of the collar facing the compression ring whereby tightening of the collar onto the leg presses the beveled surface against the compression ring to apply a compression force thereto, and a plurality of annular grooves in the leg extension each sized to receive an inner annular portion of the compression ring when its diameter is reduced upon compression by the beveled surface.

13. The exercise device of claim 12 wherein the said annular portion of the compression ring is curved in cross-section.

* * * * *